US006474309B2

(12) United States Patent
Machida et al.

(10) Patent No.: US 6,474,309 B2
(45) Date of Patent: Nov. 5, 2002

(54) FUEL INJECTION CONTROL APPARATUS

(75) Inventors: Kenichi Machida; Yoshiaki Hirakata, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/893,651

(22) Filed: Jun. 29, 2001

(65) Prior Publication Data

US 2002/0007823 A1 Jan. 24, 2002

(30) Foreign Application Priority Data

Jun. 29, 2000 (JP) ..... 2000-196360
Apr. 23, 2001 (JP) ..... 2001-124479

(51) Int. Cl.[7] ..... F02D 41/10
(52) U.S. Cl. ..... 123/492
(58) Field of Search ..... 123/492, 493, 123/445, 434, 494, 436

(56) References Cited

U.S. PATENT DOCUMENTS 4,864,999 A * 9/1989 Fujisawa ..... 123/492
4,972,820 A * 11/1990 Nakano et al. ..... 123/492
6,328,018 B1 * 12/2001 Akaska et al. ..... 123/487

FOREIGN PATENT DOCUMENTS

JP A10-259749 9/1998

* cited by examiner

*Primary Examiner*—Bibhu Mohanty
(74) *Attorney, Agent, or Firm*—Birch, Stewart, Kolasch & Birch, LLP

(57) ABSTRACT

Calculating an acceleration corrective in response to a subtle change in a throttle action by utilizing first and second rate-of-change calculators to calculate rates of change DθTHA, DθTHB of a throttle opening in preceding first and second periods (second period>first period) per a predetermined crankshaft rotational angle). A maximum value updater updates a stored value in a maximum value memory with a greater one of past and present maximum rates of change DθTH of the throttle opening, based on a compared result from a comparator. Points in a plurality of cycles read from a point calculator based on the maximum rate of change DθTH of the throttle opening are added together and inputted to a corrective value calculator. If the total of points is equal to or greater than a preset value, then an acceleration corrective quantity calculated by the corrective value calculator depending on the maximum value of rates of change of the throttle opening is supplied to a fuel injection time calculator, which calculates a fuel injection time Ti in view of the acceleration corrective quantity.

12 Claims, 5 Drawing Sheets

FIG. 4
| | MAXIMUM DθTH | POINT |
|---|---|---|
| RATE OF CHANGE OF THROTTLE OPENING < 1ST SET VALUE | | 0 |
| 1ST SET VALUE ≤ RATE OF CHANGE OF THROTTLE OPENING < 2ND SET VALUE | | α |
| 2ND SET VALUE ≤ RATE OF CHANGE OF THROTTLE OPENING < 3RD SET VALUE | | β |
| 3RD SET VALUE ≤ RATE OF CHANGE OF THROTTLE OPENING | | γ |
1ST SET VALUE < 2ND SET VALUE < 3RD SET VALUE $\alpha < \beta < \gamma$
FIG. 5
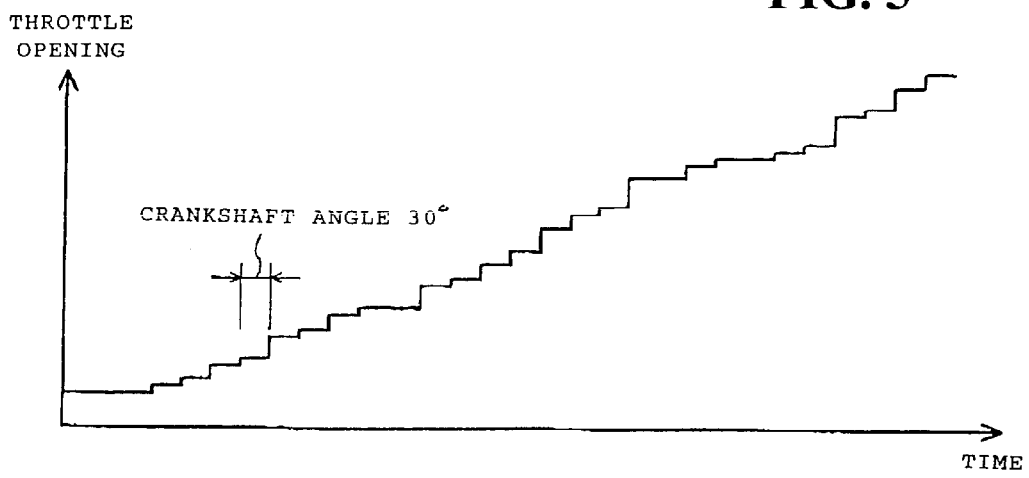
FIG. 6
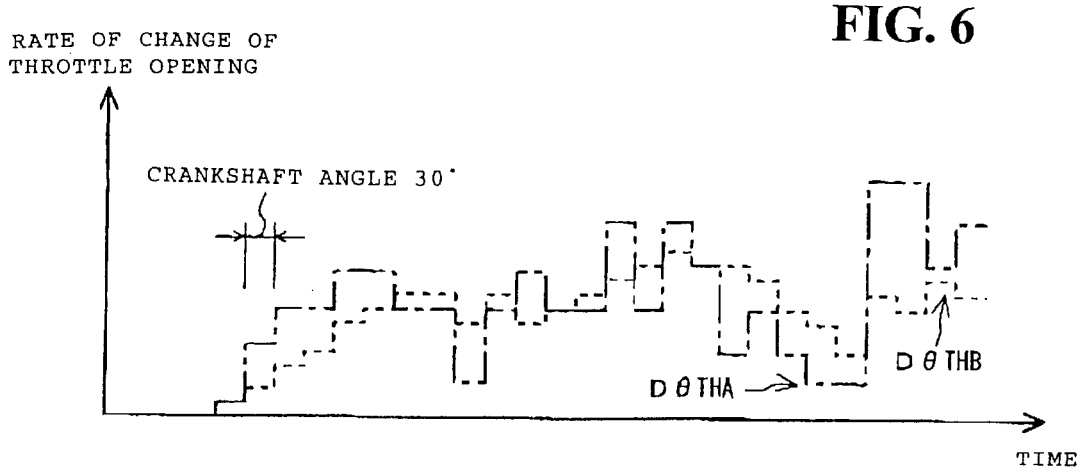

FUEL INJECTION CONTROL APPARATUS

BACKGROUND OF THE INVENTION

1. Field of the Invention

The present invention relates to a fuel injection control apparatus, and more particularly to a fuel injection control apparatus for determining an injection quantity of fuel so as to be capable of increasing the drivability upon acceleration in response to a subtle throttle action.

2. Description of Background Art

A fuel injection control apparatus is known for performing fuel injection in synchronism with the rotation of an engine and also performing asynchronous fuel injection to make up for an insufficient amount of fuel upon quick acceleration when no sufficient fuel supply is achieved by synchronous fuel injection. For example, Japanese laid-open patent publication No. 10-259749 discloses a fuel injection control apparatus which is capable of normalizing an injection quantity and an injection timing of asynchronous fuel injection depending on the acceleration pattern. The disclosed fuel injection control apparatus detects an acceleration pattern based on a change in the throttle opening, and particularly calculates the difference between throttle openings read at certain time intervals and determines the product of such differences. The product of differences well reflects an acceleration pattern to calculate an appropriate acceleration corrective quantity.

The above apparatus for calculating an acceleration corrective quantity depending on a rate of change of the throttle opening suffers the following problems: In order to calculate an accurate rate of change of the throttle opening, it is necessary that a certain large change in the throttle opening be produced. Unlike four-wheeled motor vehicles whose accelerator pedal is operated by an individual's foot, two-wheeled motor vehicles whose throttle valve is opened and closed by hand needs a subtle throttle action. Fuel injection control for two-wheeled motor vehicles requires an acceleration corrective quantity to reflect a change in the throttle opening which is caused by a subtle throttle action. However, the above apparatus fails to provide a sufficient level of accuracy for fuel injection control under subtle throttle actions.

SUMMARY AND OBJECTS OF THE INVENTION

The present invention has been made to solve the above objects. It is an object of the present invention to provide a fuel injection control apparatus which is capable of increasing the drivability by way of accurate acceleration correction for subtle throttle actions.

To achieve the above object, there is provided in accordance with a first feature of the present invention a fuel injection control apparatus having rate-of-change calculating means for calculating two rates of change of a throttle opening which have been converted for comparison with each other, based on a detected change of the throttle opening prior to two different unit times with respect to a predetermined crankshaft rotational angle which is a timing for calculating a rate of change of the throttle opening, and acceleration corrective quantity calculating means for calculating an acceleration corrective quantity of an amount of injected fuel corresponding to a larger one of the two rates of change of the throttle opening.

According to the first feature, since rates of change of the throttle opening are detected in two different unit times, an ability to detect an abrupt throttle action is increased by a rate of change of the throttle opening in shorter unit times, allowing throttle actions to be detected stably due to a rate of change of the throttle opening in longer unit times, unlike the detection of a rate of change of the throttle opening in one unit time.

According to a second feature of the present invention, the rate-of-change calculating means is arranged to calculate two rates of change of the throttle opening which have been converted for comparison with each other, based on a change of the throttle opening prior to two different crankshaft rotational angles with respect to a predetermined crankshaft rotational angle. According to the second feature, it is possible to detect rates of change of the throttle opening in two different unit times from a detected crankshaft rotational angle without the need for timer means.

According to a third feature of the present invention, the basic fuel injection quantity is calculated per a predetermined calculation timing, and the fuel injection control apparatus has maximum value calculating means for calculating a maximum value of rates of change of the throttle opening which have been calculated by the rate-of-change calculating means between a preceding calculation timing and a present calculation timing, per the calculation timing, the acceleration corrective quantity calculating means being arranged to calculate an acceleration corrective quantity of the amount of injected fuel corresponding to the maximum value. According to the third feature, the accuracy of detection can be increased by performing acceleration correction corresponding to a maximum value of rates of change of the throttle opening between calculation timings.

According to a fourth feature of the present invention, the fuel injection control apparatus includes point calculating means for calculating a point corresponding to the maximum value, and adding means for calculating a total value of points per a predetermined number of times, and the acceleration corrective quantity calculating means calculates an acceleration corrective quantity only if the total value is greater than a reference value. According to the fourth feature, even when the rate of change of the throttle opening is small, if a point is calculated in each cycle, then since the total value is large, a stable accelerated state is detected, and an acceleration corrective quantity is calculated according to the maximum value of the latest rate of change of the throttle opening at that time. If a point is not calculated in each cycle, e.g., if the throttle opening changes due to noise or a reading tolerance, then since the total value is small, no acceleration corrective quantity is calculated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4 is a diagram showing, by way of example, a weighting table with respect to rates of change of a throttle opening;

FIG. 5 is a diagram showing changes in a throttle opening;

FIG. 6 is a diagram showing transitions of a rate of change of a throttle opening.

DETAILED DESCRIPTION OF THE PREFERRED EMBODIMENTS

Figure 2:
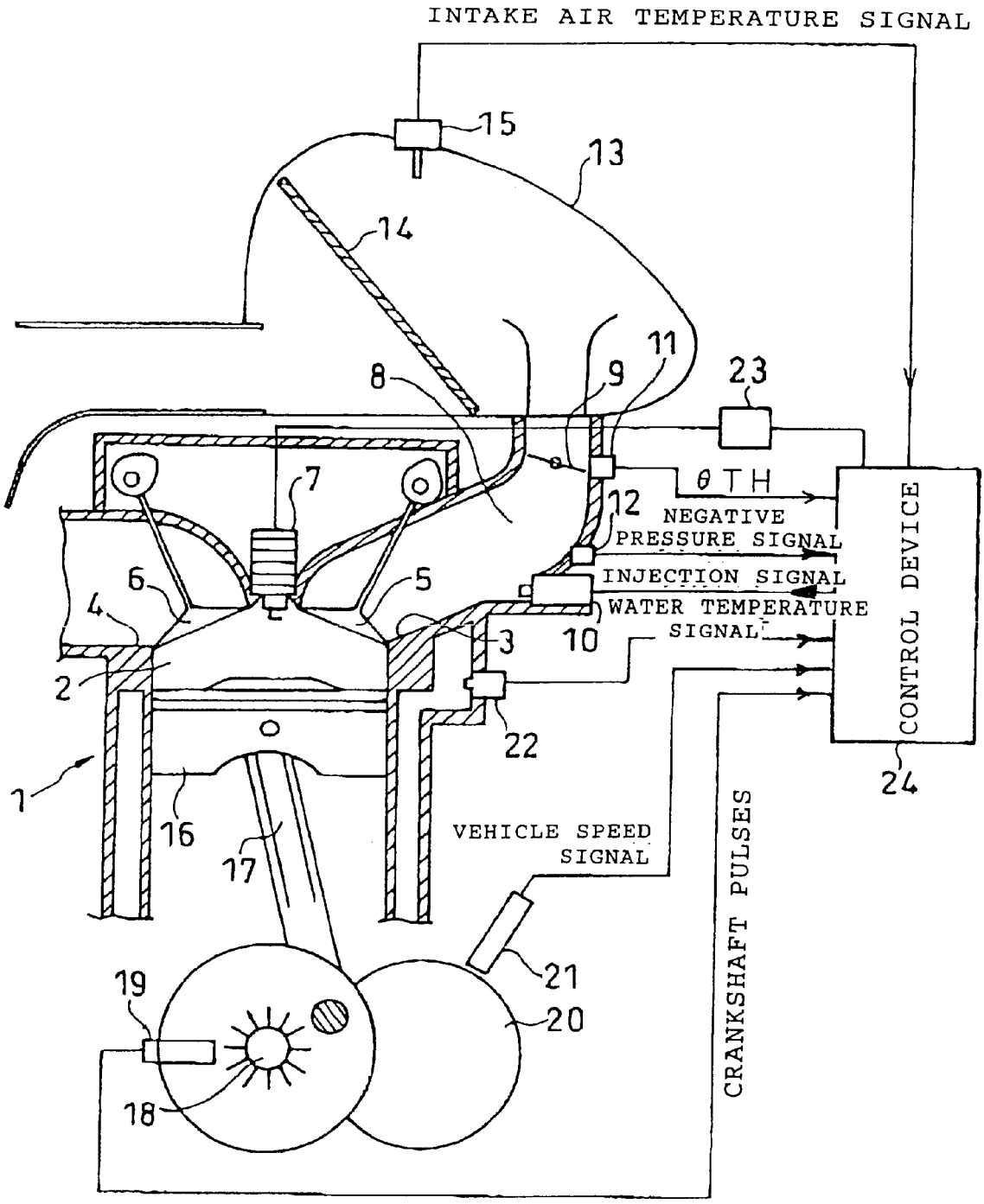
FIG. 2 is a view of an essential part of an internal combustion engine which incorporates the fuel injection control apparatus according to the present invention.

The present invention will be described below with reference to the drawings. FIG. 2 is a view of an essential part of an internal combustion engine which incorporates a fuel injection control apparatus according to an embodiment of the present invention. In FIG. 2, an intake port 3 and an exhaust port 4 are open into a combustion chamber 2 of a cylinder 1, and an intake valve 5 and an exhaust valve 6 are disposed respectively in the intake port 3 and the exhaust port 4. An ignition plug 7 is disposed in the combustion chamber 2.

An intake passage 8 communicating with the intake port 3 has a throttle valve 9 for adjusting the amount of intake air depending on its opening θTH, a fuel injection valve 10, a throttle sensor 11 for detecting the opening θTH, and a negative pressure sensor 12. To the terminal end of the intake passage 8, there is connected an air cleaner 13 which houses an air filter 14 for introducing external air therethrough into the intake passage 8. An intake air temperature sensor 15 is disposed in the air cleaner 13.

The cylinder 1 houses a piston 16 therein which is connected to a crankshaft 18 by a connecting rod 17. A rotational angle sensor 19 is disposed in confronting relation to the crankshaft 18 for detecting a rotational angle of the crankshaft 18 and for outputting a crankshaft pulse for each given crankshaft angle. A vehicle speed sensor 21 is disposed in confronting relation to a rotatable body 20 such as a gear or the like that is coupled to the crankshaft 18. The cylinder 1 is surrounded by a water jacket having a water temperature sensor 22 for detecting the temperature of a coolant which represents an engine temperature. An ignition coil 23 is connected to the ignition plug 7.

A control device 24 comprises a microcomputer having a CPU and a memory, and has interface elements including input/output ports and an A/D converter. The control device 24 is supplied with electric energy from a battery, not shown. Output signals from the various sensors are supplied via the input ports to the control device 24. The control device 24 outputs drive signals to the fuel injection valve 10 and the ignition plug 7 according to processed results based on the input signals from the sensors. The drive signal for the fuel injection valve 10 (injection signal) is a pulse signal having a pulse duration depending on an injection quantity. The fuel injection valve 10 is opened for a time corresponding to the pulse duration to inject fuel into the intake passage 8.

The pulse duration of the injection signal, i.e., the fuel injection time, is calculated based on an engine rotational speed Ne and the detected value of the throttle sensor 11 (throttle opening θTH). In this embodiment, the differences (a rate of change of the throttle opening) between throttle openings detected at timings prior to two different crankshaft rotational angles with respect to a predetermined crankshaft rotational angle and a present throttle opening are converted into changes in a given unit time for comparison with each other. Rates of change of the throttle opening are calculated based on the changes, and compared with each other. The larger one of the compared rates of change of the throttle opening is regarded as a present detected rate of change of the throttle opening. If the present detected value is greater than a maximum rate of change of the throttle opening within a predetermined period so far, then the maximum rate of change of the throttle opening is updated.

In order to grasp a slight rate of change of the throttle opening, a point corresponding to the maximum rate of change of the throttle opening per calculation timing is calculated. Then, the total value of the predetermined number of points is calculated. If it is determined that acceleration correction is to be made according to a decision based on the total value of points, then a predetermined acceleration corrective quantity corresponding to the maximum rate of change of the throttle opening is calculated.

Figure 3:
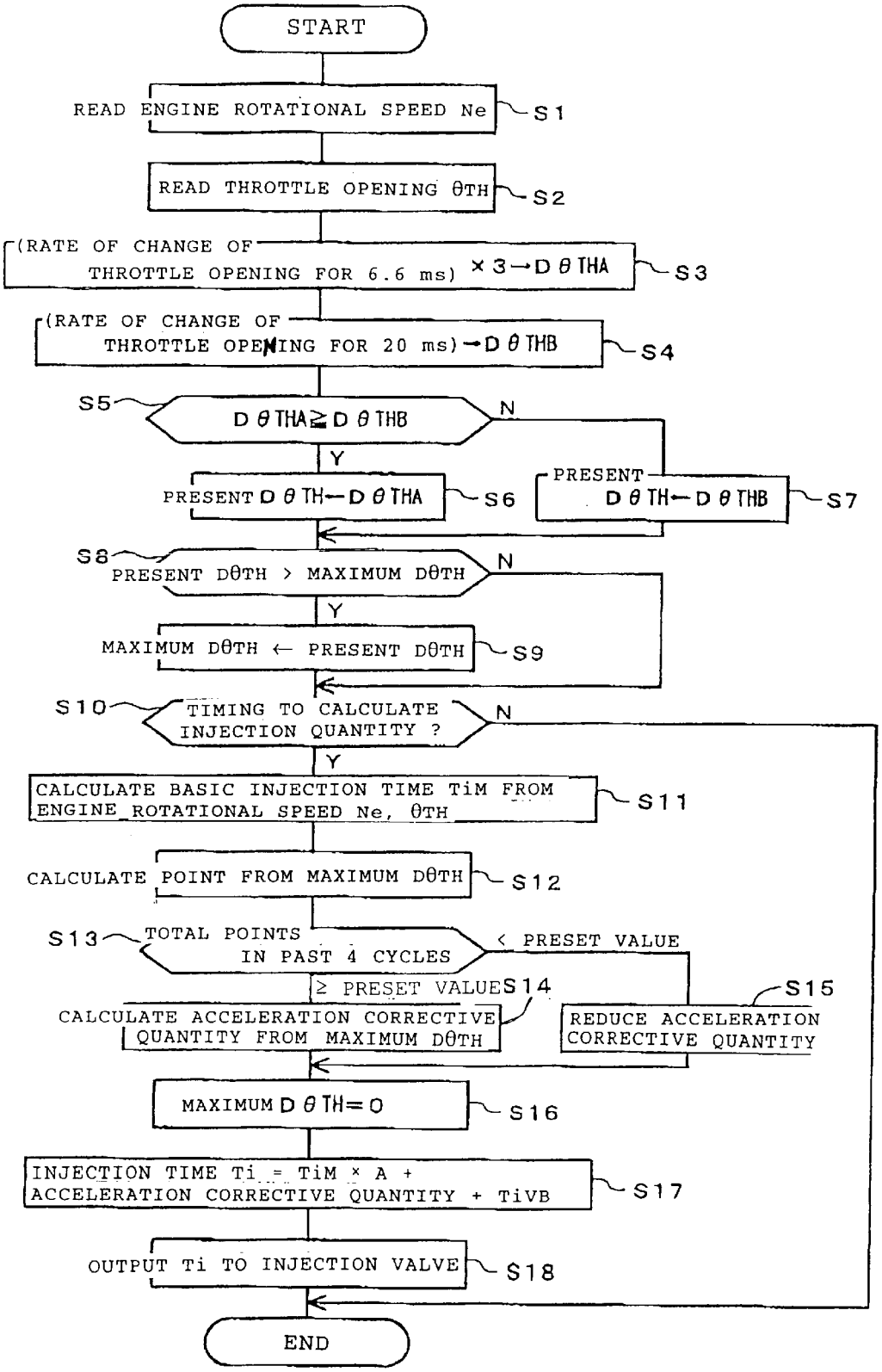
FIG. 3 is a flowchart of a fuel injection process.

FIG. 3 is a flowchart of a fuel injection process. In step S1, an engine rotational speed Ne is read. The engine rotational speed Ne is determined by counting crankshaft pulses outputted from the rotational angle sensor 19. In step S2, a throttle opening θTH is read. In step S3, a change of the throttle opening θTH for the preceding 6.6 ms (milliseconds) is calculated, and tripled for a conversion into a value for 20 ms, which is stored as a rate of change DθTHA of the throttle opening. In step S4, a change of the throttle opening θTH for the preceding 20 ms is calculated, and stored as a rate of change DθTHB of the throttle opening. Since these two rates of change DθTHA, DθTHB of the throttle opening are in the same range, they can be compared with each other.

The rates of change of the throttle opening for 6.6 ms and 20 ms can be calculated from a throttle opening difference in the crankshaft rotational angle per a predetermined rotational speed range. For example, if the engine rotational speed Ne is lower than 1500 rpm, then a throttle opening difference is calculated between values detected in a range of the crankshaft rotational angle of 60° and between values detected in a range of the crankshaft rotational angle of 180° respectively. If the engine rotational speed Ne ranges between 1500 and 3000 rpm, then a throttle opening difference is calculated between values detected in a range of the crankshaft rotational angle of 120° and between values detected in a range of the crankshaft rotational angle of 360° respectively. If the engine rotational speed Ne ranges between 3000 and 6000 rpm, then a throttle opening difference is calculated between the values detected in a range of the crankshaft rotational angle of 240° and between values detected in a range of the crankshaft rotational angle of 720° respectively. If the engine rotational speed Ne is equal to or higher than 6000 rpm, then a throttle opening difference is calculated between values detected in a range of the crankshaft rotational angle of 480° and between values detected in a range of the crankshaft rotational angle of 1440° respectively.

An example of calculations when the engine rotational speed Ne is lower than 1500 rpm is given as follows: The change of the throttle opening for 6.6 ms is tripled for conversion into a value corresponding to 20 ms, which is a rate of change DθTH (=DθTHA) of the throttle opening=the absolute value of (present θTH−θTH that is 60° before)×Ne÷1500×3 . . . (F1). A rate of change DθTH (=DθTHB) of the throttle opening calculated from the change of the throttle opening for 20 ms=the absolute value of (present θTH−θTH that is 180° before)×Ne÷1500 . . . (F2).

In step S5, it is determined whether or not the rate of change DθTHA of the throttle opening is equal to or greater than the rate of change DθTHB of the throttle opening. If the rate of change DθTHA of the throttle opening is equal to or greater than the rate of change DθTHB of the throttle opening, then control goes to step S6 to store the rate of change DθTHA of the throttle opening as a present rate of change of the throttle opening. If the rate of change DθTHA of the throttle opening is less than the rate of change DθTHB of the throttle opening, then control goes to step S7 to store the rate of change DθTHB of the throttle opening as a present rate of change of the throttle opening.

In step S8, the maximum rate of change DθTH of the throttle opening up to the preceding cycle is compared with the present rate of change DθTH of the throttle opening. If the present value is greater than the maximum rate of change DθTH of the throttle opening so far, then control goes to step S9 to update the maximum rate of change DθTH of the throttle opening. If the present value is smaller than the maximum rate of change DθTH of the throttle opening so far, then step S9 is skipped, and control proceeds to step S10. The calculations in steps S1 through S9 are performed per a predetermined crankshaft rotational angle (e.g., 30°).

In step S10, it is determined whether the present time is a timing to calculate a fuel injection quantity or not. A fuel injection quantity is calculated per a certain crankshaft rotational angle (e.g., 180°). If the answer to step S10 is affirmative, then control goes to step S11 to calculate a basic injection time TiM calculated from the engine rotational speed Ne and the throttle opening θTH. The basic injection quantity TiM can be retrieved from a map established as a function of the engine rotational speed Ne and the throttle opening θTH. Since the injection quantity corresponds to the injection time, the injection time will be described as representing the injection quantity.

In step S12, a point, i.e., a weighting constant, is calculated based on the maximum rate DθTH of change of the throttle opening. A preset value corresponding to the maximum rate DθTH of change of the throttle opening can be used as such a point. FIG. 4 is a diagram showing an association between maximum rates DθTH of change of the throttle opening and points. In FIG. 4, points are set depending on the relationship to set values. An example of points α, β, γ (α<β<γ) is that α=1, β=2, and γ=4. An example of three set values (first set value<second set value<third set value) corresponding to rates DθTH of change of the throttle opening at intervals of 20 ms is that the first set value=0.195°/20 ms, the second set value=0.293°/20 ms, and the third set value=0.391°/20 ms. Set values for assigning points are not limited to the three set values.

In step S13, a total value of points in the past four cycles is compared with a reference value. If the total value is equal to or greater than the reference value, then control goes to step S14 in which an acceleration corrective quantity is calculated based on the maximum rate DθTH of change of the throttle opening. If the total value is less than the reference value, then control goes to step S15 in the process for reducing the acceleration corrective quantity. Specifically, if an acceleration corrective quantity has been calculated at the preceding injection calculation timing, then the calculated acceleration corrective quantity is reduced by a predetermined quantity. If the acceleration corrective quantity calculated at the preceding injection calculation timing is "0", then "the acceleration corrective quantity=0" is calculated.

In step S16, an initializing process for a next fuel injection quantity calculation timing (e.g., per a crankshaft rotational angle 180°) is performed as by resetting the maximum rate DθTH of change of the throttle opening to "0". Points may be totaled in a plurality of cycles which are not limited to four cycles. However, since points totaled in an extremely large number of cycles would make it difficult to grasp the degree of acceleration, points may be totaled in nearly four cycle, i.e., in two through six cycles.

In step S17, the basic injection time TiM is multiplied by a corrective coefficient A such as a water temperature corrective coefficient, an intake temperature corrective coefficient, or an atmospheric pressure corrective coefficient, and then the acceleration corrective quantity and an invalid injection time TiVB are added to calculate a fuel injection time Ti. The invalid injection time TiVB represents a time in the valve opening time where full fuel injection does not take place, and is determined by the type and structure of the fuel injection valve 10.

In step S18, a drive signal for the fuel injection valve 10 is outputted during the fuel injection time Ti. While the drive signal is being outputted, the fuel injection valve 10 is opened to inject fuel into the intake passage 8.

FIGS. 5 and 6 are diagrams showing changes in the throttle opening θ and changes in the rate DθTH of change of the throttle opening which are caused by such changes in the throttle opening θ. The axis representing time in FIGS. 5 and 6 represents crankshaft rotational angles. The rate DθTH of change of the throttle opening represents the rate DθTHA of change which is produced by tripling the change of the throttle opening between preceding 6.6 ms per a crankshaft rotational angle (30°) for conversion into a change corresponding to 20 ms, and the rate DθTHB of change based on the change of the throttle opening between preceding 20 ms. The values between preceding 6.6 ms and between preceding 20 ms, i.e., the values (DθTHA/DθTHB) calculated in steps S3, S4, are greatly different from each other.

Figure 7:
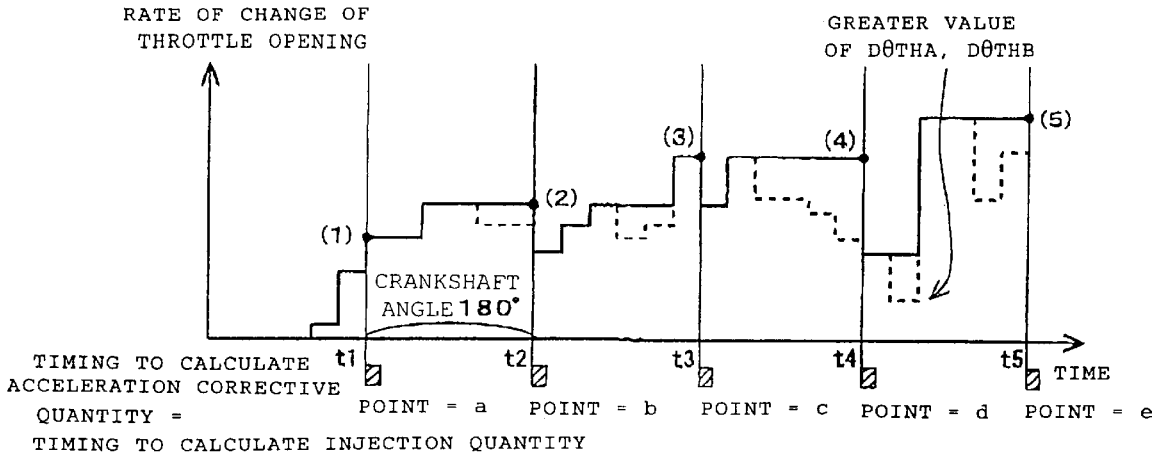
FIG. 7 is a diagram showing transitions of a maximum value of rates of change of a throttle opening.

Values produced after a greater one of the rate DθTHA of change which is produced by tripling the change of the throttle opening between preceding 6.6 ms per a crankshaft rotational angle 30° for conversion into a change corresponding to 20 ms, and the rate DθTHB of change between preceding 20 ms is employed, and a maximum value in a predetermined period is left, i.e., values produced after the processing in steps S6, S7, S8, S9, are shown in FIG. 7. As shown in FIG. 7, points a, b, c, d, e are calculated at timings t1, t2, t3, t4, t5 with respect to maximum rates of change DθTH(1), (2), (3), (4), (5) of the throttle opening calculated by the values in a range of the crankshaft rotational angle of 180°, and points in the past four cycles are added at each of the timings. For example, the points a, b, c, d are added at the timing t4, and the points b, c, d, e are added at the timing t5. If the total of the points is equal to or greater than a preset value, then an acceleration corrective quantity is calculated depending on the maximum rate of change DθTH of the throttle opening at the time.

Figure 1:
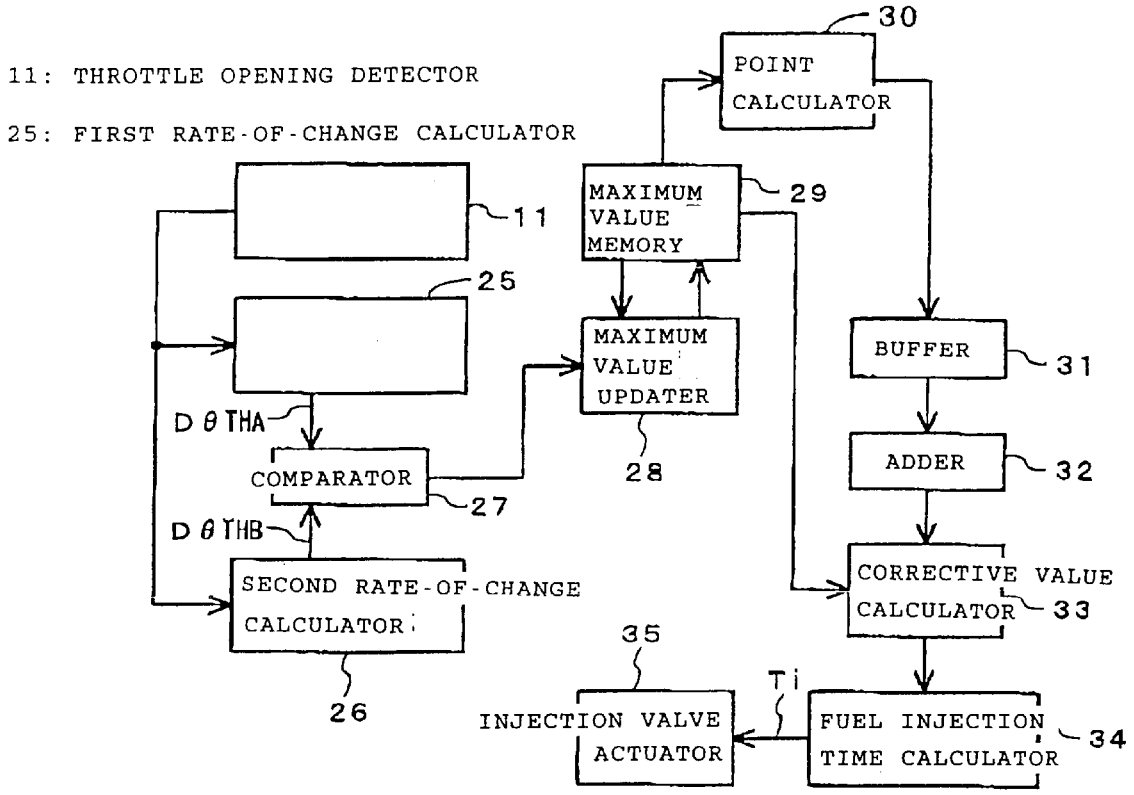
FIG. 1 is a block diagram of essential functions of a fuel injection control apparatus according to an embodiment of the present invention.

FIG. 1 is a block diagram showing essential functions of the fuel injection control apparatus according to the embodiment of the present invention. In FIG. 1, an output signal from a throttle opening detector, i.e., the throttle sensor 11, is converted by an A/D converter, not shown, into a digital signal for microcomputer processing. The digital signal is then inputted to a first throttle opening rate-of-change calculator (first rate-of-change calculator) 25 and a second throttle opening rate-of-change calculator (second rate-of-change calculator) 26. The first rate-of-change calculator 25 calculates a rate of change DθTHA of the throttle opening in a preceding first period per a predetermined crankshaft rotational angle. Similarly, the second rate-of-change calculator 26 calculates a rate of change DθTHB of the throttle opening in a preceding second period (longer than the first period) per a predetermined crankshaft rotational angle. The first rate-of-change calculator 25 and the second rate-of-change calculator 26 generate output values converted from changes in the throttle opening so as to equalize the ranges of the output values depending on the ratio of the two periods.

A comparator 27 compares the rate of change DθTHA of the throttle opening and the rate of change DθTHB of the throttle opening with each other, and supplies a greater one of rate of change to a maximum value updater 28. The maximum value updater 28 stores a greater one of a maximum rate of change DθTH of the throttle opening stored in a maximum value memory 29 and the present maximum rate of change DθTH of the throttle opening, in the maximum value memory 29.

A point calculator 30 calculates a point corresponding to the maximum rate of change DθTH of the throttle opening stored in the maximum value memory 29 (see FIG. 4), and outputs a point to a buffer 31.

The buffer 31 can store points in a plurality of the latest cycles (e.g., four cycles). The points in the plurality of cycles stored in the buffer 31 are read into an adder 32, which adds them together and supplies the total of points to a corrective value calculator 33. If the supplied total of points is equal to or greater than a preset value, then the corrective value calculator 33 calculates an acceleration corrective quantity depending on the maximum rate of change DθTH of the throttle opening. The calculated acceleration corrective quantity is supplied to a fuel injection time calculator 34, which calculates a fuel injection time Ti in view of the acceleration corrective quantity. The calculated fuel injection time Ti is supplied to an injection valve actuator 35.

While a rate of change of the throttle opening has been calculated at two timings prior to a predetermined crankshaft rotational angle, it is also effective to calculate a rate of change of the throttle opening at one timing and to calculate the acceleration corrective quantity by weighting with points. A rate of change of the throttle opening may not be calculated based on the difference between detected values at predetermined crankshaft rotational angles, but may be calculated by detecting the difference per given time according to timer processing.

According to the present embodiment, as described above, since a rate of change of the throttle opening is calculated at two preceding timings per a predetermined crankshaft rotational angle, a change in the throttle opening, irrespective of whether it is sharp or gradual, can be detected and can be reflected in an acceleration corrective quantity. The accuracy of an acceleration corrective quantity can be increased based on a maximum value of rates of change of the throttle opening per a predetermined crankshaft rotational angle. It is determined whether acceleration correction is to be carried out according to weighting based on the maximum value or not, so that the acceleration corrective quantity can reflect a subtle rate of change of the throttle opening.

As described above, according to the present invention, it is possible to accurately calculate an acceleration corrective quantity for fuel depending on a rate of change of a throttle opening upon acceleration. Particularly, according to the present invention, since rates of change of the throttle opening in two unit times are calculated, an ability to detect an abrupt throttle action is increased for a better response by a rate of change of the throttle opening in shorter unit times, allowing throttle actions to be detected stably due to a rate of change of the throttle opening in longer unit times, unlike the detection of a rate of change of the throttle opening in one unit time.

According to the present invention, it is possible to detect rates of change of the throttle opening in two different unit times from a detected crankshaft rotational angle without the need for timer means.

According to the present invention, an acceleration corrective quantity is calculated according to a maximum value of rates of change of the throttle opening between timings to calculate a basic fuel injection quantity. According to the fourth feature, even when the rate of change of throttle opening is small, if a point is calculated in each cycle, then since the total value is large, a stable accelerated state is detected, and an acceleration corrective quantity is calculated according to the maximum value of the latest rate of change of the throttle opening at that time. If a point is not calculated in each cycle, e.g., if the throttle opening changes due to noise or a reading tolerance, then since the total value is small, no acceleration corrective quantity is calculated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injection control apparatus for correcting a basic fuel injection quantity upon acceleration with an acceleration corrective quantity corresponding to a rate of change of a throttle opening which is calculated per a predetermined crankshaft rotational angle, comprising:

throttle opening detecting means;

rate-of-change calculating means for calculating two rates of change of the throttle opening which have been converted for comparison with each other, based on a detected change of the throttle opening prior to two different unit times with respect to said predetermined crankshaft rotational angle; and acceleration corrective quantity calculating means for calculating an acceleration corrective quantity of an amount of injected fuel corresponding to a larger one of said two rates of change of the throttle opening.

2. The fuel injection control apparatus according to claim 1, wherein said rate-of-change calculating means is arranged to calculate two rates of change of the throttle opening which have been converted for comparison with each other, based on a change of the throttle opening prior to two different crankshaft rotational angles with respect to a predetermined crankshaft rotational angle.

3. The fuel injection control apparatus according to claim 1, wherein said basic fuel injection quantity is calculated per a predetermined calculation timing, and comprising:

maximum value calculating means for calculating a maximum value of rates of change of the throttle opening which have been calculated by said rate-of-change calculating means between a preceding calculation timing and a present calculation timing, per said calculation timing;

said acceleration corrective quantity calculating means being arranged to calculate an acceleration corrective quantity of the amount of injected fuel corresponding to said maximum value.

4. The fuel injection control apparatus according to claim 2, wherein said basic fuel injection quantity is calculated per a predetermined calculation timing, and comprising:

maximum value calculating means for calculating a maximum value of rates of change of the throttle opening which have been calculated by said rate-of-change calculating means between a preceding calculation timing and a present calculation timing, per said calculation timing;

said acceleration corrective quantity calculating means being arranged to calculate an acceleration corrective quantity of the amount of injected fuel corresponding to said maximum value.

5. The fuel injection control apparatus according to claim 3, and further including:

point calculating means for calculating a point corresponding to said maximum value; and adding means for calculating a total value of points per a predetermined number of times;

wherein said acceleration corrective quantity calculating means calculates an acceleration corrective quantity only if said total value is greater than a reference value.

6. The fuel injection control apparatus according to claim 4, and further including:

point calculating means for calculating a point corresponding to said maximum value; and adding means for calculating a total value of points per a predetermined number of times;

wherein said acceleration corrective quantity calculating means calculates an acceleration corrective quantity only if said total value is greater than a reference value.

7. A fuel injection control apparatus for correcting a basic fuel injection quantity upon acceleration with an acceleration corrective quantity corresponding to a rate of change of a throttle opening which is calculated per a predetermined crankshaft rotational angle, comprising:

throttle opening detecting means;

rate-of-change calculating means for calculating two rates of change of the throttle opening based on the changes and compared with each other, based on a maximum rate of change of the throttle opening prior to two different unit times with respect to said predetermined crankshaft rotational angle; and acceleration corrective quantity calculating means for calculating an acceleration corrective quantity of an amount of injected fuel corresponding to a maximum value of the rates of change of the throttle opening per a predetermined crankshaft rotational angle.

8. The fuel injection control apparatus according to claim 7, wherein said rate-of-change calculating means is arranged to calculate two rates of change of the throttle opening based on the changes and compared with each other, based on a change of the throttle opening prior to two different crankshaft rotational angles with respect to a predetermined crankshaft rotational angle.

9. The fuel injection control apparatus according to claim 7, wherein said basic fuel injection quantity is calculated per a predetermined calculation timing, and comprising:

maximum value calculating means for calculating a maximum value of rates of change of the throttle opening which have been calculated by said rate-of-change calculating means between a preceding calculation timing and a present calculation timing, per said calculation timing;

said acceleration corrective quantity calculating means being arranged to calculate an acceleration corrective quantity of the amount of injected fuel corresponding to said maximum value.

10. The fuel injection control apparatus according to claim 8, wherein said basic fuel injection quantity is calculated per a predetermined calculation timing, and comprising:

maximum value calculating means for calculating a maximum value of rates of change of the throttle opening which have been calculated by said rate-of-change calculating means between a preceding calculation timing and a present calculation timing, per said calculation timing;

said acceleration corrective quantity calculating means being arranged to calculate an acceleration corrective quantity of the amount of injected fuel corresponding to said maximum value.

11. The fuel injection control apparatus according to claim 9, and further including:

point calculating means for calculating a point corresponding to said maximum value; and adding means for calculating a total value of points per a predetermined number of times;

wherein said acceleration corrective quantity calculating means calculates an acceleration corrective quantity only if said total value is greater than a reference value.

12. The fuel injection control apparatus according to claim 10, and further including:

point calculating means for calculating a point corresponding to said maximum value; and adding means for calculating a total value of points per a predetermined number of times;

wherein said acceleration corrective quantity calculating means calculates an acceleration corrective quantity only if said total value is greater than a reference value.

* * * * *